US006505677B1

(12) United States Patent
Iversen et al.

(10) Patent No.: US 6,505,677 B1
(45) Date of Patent: Jan. 14, 2003

(54) METHOD AND APPARATUS FOR CASTING METAL ARTICLES WITH COUNTER-GRAVITY SUPPLY OF METAL TO MOULDS

(75) Inventors: Peter M¥ller Iversen, Brønshøj (DK); Uffe Andersen, Skævinge (DK)

(73) Assignee: Georg Fischer Disa A/S, Herlev (DK)

( * ) Notice: Subject to any disclaimer, the term of this patent is extended or adjusted under 35 U.S.C. 154(b) by 0 days.

(21) Appl. No.: 09/674,715

(22) PCT Filed: May 4, 1999

(86) PCT No.: PCT/DK99/00246

§ 371 (c)(1),
(2), (4) Date: Nov. 6, 2000

(87) PCT Pub. No.: WO99/58271

PCT Pub. Date: Nov. 18, 1999

(30) Foreign Application Priority Data

May 7, 1998 (EP) ..... 98108289

(51) Int. Cl.[7] ..... B22D 18/00; B22D 46/00

(52) U.S. Cl. ..... 164/457; 164/119; 164/133; 164/155.2; 164/306

(58) Field of Search ..... 164/119, 113, 164/120, 133, 285, 363, 4.1, 457, 151, 151.3, 155.2, 155.3, 306

(56) References Cited

U.S. PATENT DOCUMENTS 3,951,199 A * 4/1976 Pereira ..... 164/457
4,585,050 A * 4/1986 Merrien et al. ..... 164/457
4,860,820 A * 8/1989 Pereira ..... 164/457
5,551,502 A * 9/1996 Matsubayashi et al. ..... 164/457
5,597,032 A * 1/1997 Merrien ..... 164/457
5,725,043 A * 3/1998 Schaefer et al. ..... 164/119
6,247,521 B1 * 6/2001 Kawai et al. ..... 164/457
6,341,640 B1 * 1/2002 Iversen et al. ..... 164/133

FOREIGN PATENT DOCUMENTS

| | | | |
|---|---|---|---|
| DE | 44 02 509 A1 * | 8/1995 | B22D/39/06 |
| EP | 0 128 280 A1 * | 12/1984 | B22D/11/16 |
| EP | 0 135 305 | 3/1985 | |
| JP | 2-53859 | 4/1990 | |
| WO | WO 89/07879 A2 * | 9/1989 | B22D/18/04 |

* cited by examiner

*Primary Examiner*—M. Alexandra Elve
*Assistant Examiner*—Kevin P. Kerns
(74) *Attorney, Agent, or Firm*—Larson & Taylor PLC

(57) ABSTRACT

When casting metal articles in a mould by forcing molten metal upwardly through a filling tube by gas pressure in a closed chamber, the datum level just below that of a connector connecting the filling tube to the mould is registered by a level sensor in a sensing tube while the latter's upper end is connected to atmosphere through a vent tube. At the same moment, the pressure is measured by a pressure sensor and recorded by a control unit and maintained constant by the latter after the emptying of the sensing tube, by connecting its upper end to the chamber through an equalizing tube, until the pressure is increased to fill the mould according to a predetermined function of time programmed into the control unit. The starting point for the filling of all moulds in succession is the same, regardless of the amount of metal in the supply unit.

3 Claims, 2 Drawing Sheets

METHOD AND APPARATUS FOR CASTING METAL ARTICLES WITH COUNTER-GRAVITY SUPPLY OF METAL TO MOULDS

TECHNICAL FIELD

The present invention relates to an apparatus and a method of casting metal articles in moulds having inlets at the side or bottom. The apparatus comprises a) a supply unit for molten metal comprising a closed chamber capable of containing a mass of molten metal in its bottom region and a gas above the mass, b) a filling tube extending from the bottom region upwardly to a connector for temporary connection to a filling duct in a mould for casting an article of metal, c) means to vary the pressure in the gas between low values, at which metal from the mass when rising through the filling tube does not reach the connector, and higher values, at which molten metal is made to flow through the connector into the filling conduit in the mould.

BACKGROUND ART

When previously carrying out a method of the kind referred to above, difficulties have been encountered when adjusting the level of metal in the filling tube prior to the process of filling each mould with a view to achieving identical starting points for the filling of all moulds being filled successively. Previous attempts at determining the pressure corresponding to the datum level of the molten metal in the filling tube just prior to filling of each mould have not been very successful, because it has been based upon a computation of the difference in level between the connector to be connected to each mould and the level of the mass of metal contained in the supply unit. This computation is not particularly accurate, and is not made easier by the fact that the surface of the mass and metal in the supply unit is lowered upon each casting operation, possibly also reduced due to the limiting walls not being vertical or parallel.

From WO-A-89/07879 a die casting process of this kind is known. A sealed vessel with molten metal is via a filling tube temporarily connected to a mould and the molten metal is filled into the mould by a rising gas pressure in the vessel. A level indicator is provided in the filling tube to ensure equal starting level of the melt for each new mould to be filled.

DISCLOSURE OF THE INVENTION

It is the object of the present invention to provide an apparatus and a method of the kind referred to above, with which it is possible to ensure that each single process of casting in each of the successive moulds proceeds from the same starting point represented by the datum level referred to above, and this object is achieved by, according to the invention, proceeding in the manner set forth in detail hereinbelow. By so doing, the datum level is determined for each and every mould, independently of the level of metal in the reservoir in the supply unit.

BRIEF DESCRIPTION OF THE DRAWINGS

In the following detailed part of the present description, the invention will be explained in more detail with reference to the exemplary embodiment of an apparatus according to the invention shown in the drawings, in which.

DESCRIPTION OF THE PREFERRED EMBODIMENT

Figure 1:
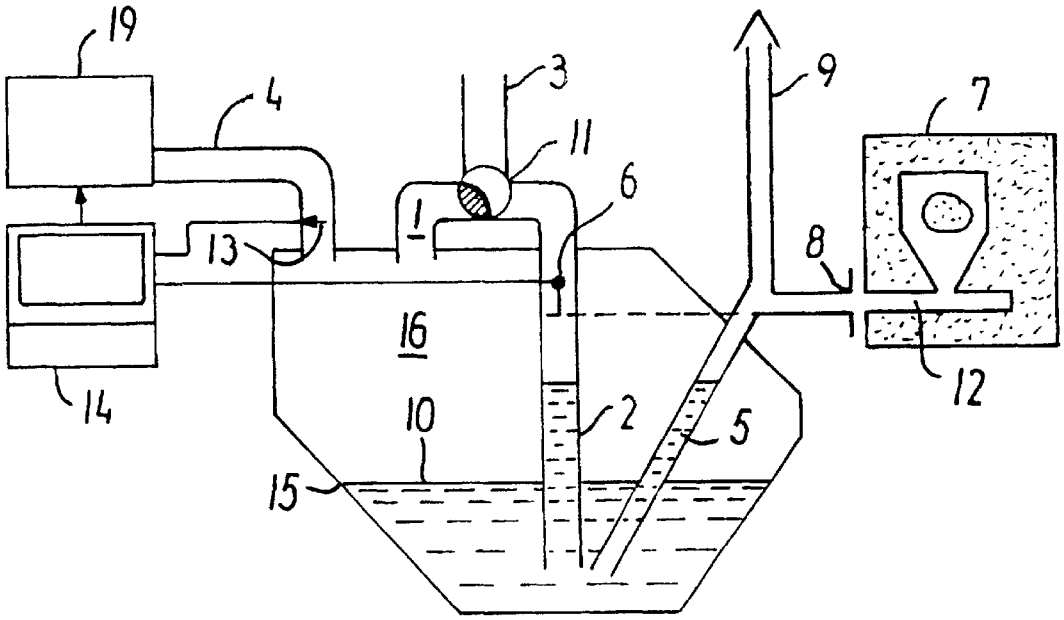
FIGS. 1–4 are diagrammatic views in cross-section, showing the apparatus in various stages of carrying out the method.

The apparatus shown on the drawing comprises a supply unit 15 intended to be substantially stationary in a pouring station of a moulding and casting plant, such as one constructed upon the well-known DISAMATIC® principle. The supply unit 15 is adapted to supply molten metal from a mass 10 of molten metal resting in the bottom region of a closed chamber 16 within the supply unit by, through the use of gas pressure supplied from a gas-supply unit 19 through a gas-supply conduit 4, forcing molten metal from the mass 10 upwardly through a filling tube 5 to a connector 8 adapted for temporary connection to the filling conduit or runner 12 in a mould 7, in which an article is to be cast. Branched from the upper end of the filling tube 5 is also, optionally, an external riser 9 that can be used to influence the filling of the mould 7. This far, only previously known features of such apparatus have been described.

The main novel feature of the invention is the arrangement for controlling the initiation of the casting operation by sensing the pressure in the closed chamber 16. This arrangement comprises a sensing tube 2 extending from a location close to the bottom of the closed chamber 16 to outside of this chamber, terminating in a three-way valve 11 with two positions. To this valve are also connected a pressure-equalization tube 1 and a vent tube 3, the valve 11 being so arranged that it either, in the manner shown in FIGS. 1 and 2, connects the sensing tube 2 to the vent tube 3, and a position, in which it connects the sensing tube 2 to the pressure-equalization tube 1 in the manner shown in FIGS. 3 and 4.

Further equipment includes a level sensor 6 placed in the sensing tube at such a level that when the level of molten metal in the sensing tube rises to a level the same as or just below the level of the connector 8, the sensor 6 reacts and sends a signal to a control unit 14 adapted to control the operation of the apparatus including the gas-supply unit 19, possibly also of other parts (not shown) of the plant in response to i.a. signals from the level sensor 6 and from a pressure sensor 13 adapted to measure the pressure in the closed chamber 16.

The operation of the apparatus will now be described as a sequence of events shown in FIGS. 1–4.

Figure 2:
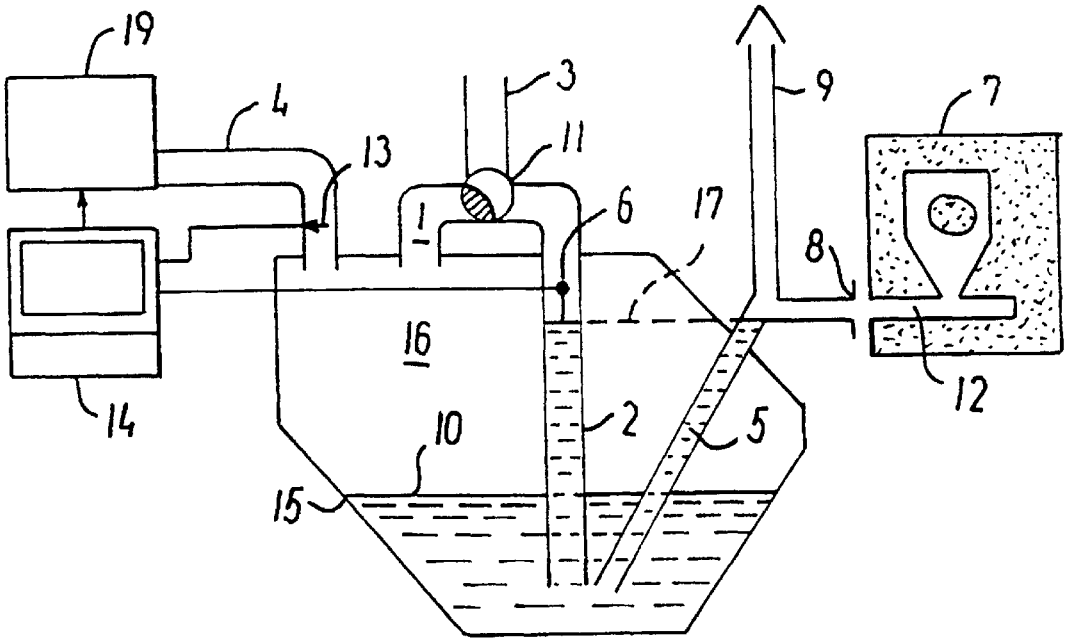

In FIG. 1, the three-way valve 11 is in its first position, in which it connects the sensing tube 2 to the vent tube 3 and thus to atmosphere. A fresh mould 7 has just been placed with its runner 12 connected to the connector 8. The level of the molten metal 10 is the same in the sensing tube 2 and in the filling tube 5, but higher than in the closed chamber 16 due to a moderate gas pressure being applied through the gas-supply conduit 4. With the valve 11 in the position shown in FIG. 1, gas pressure in the gas-supply conduit 4 is now increased, causing the molten metal to rise in the sensing tube 2 as well as in the filling tube 5. As shown in FIG. 2, the rising metal column in the sensing tube 2 activates the level sensor 6 to send a signal to the control unit 14, the latter at this instant recording the pressure in the closed chamber 16 as sensed by the pressure sensor 13, making a note of this pressure as a datum pressure, at which the metal column in the sensing tube 2 just touches the level sensor 6. A datum pressure corresponding to a datum level, at which the metal column in the sensing tube 2 just touches the level sensor 6, having now been recorded by the control unit 14, the next step shown in FIG. 3 can now be carried out.

Figure 3:
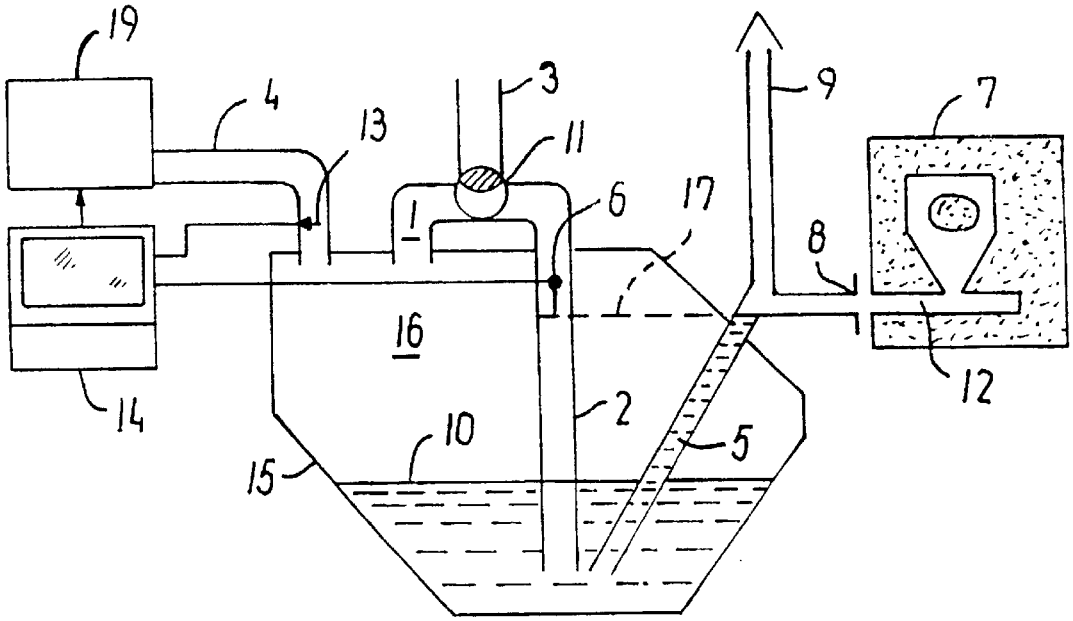

In the situation shown in FIG. 3, the three-way valve 11 is in its second position, in which it connects the sensing tube 2 to the pressure-equalization tube 1, so that there is no longer any pressure differential to hold a column of metal up against the level sensor 6. The level of metal in the filling tube 5 is, however, the same as shown in FIG. 2, because the upper end of the filling tube 5 is still connected to atmosphere through the external riser 9. According to the invention, the level of metal in the filling tube 5 is maintained at this level by suitably controlling the gas-supply unit 19 to maintain the pressure in the closed chamber 16 at the previously recorded datum value established in the step shown in FIG. 2 and described above.

It is important at this stage to note that the level of metal in the filling tube 5 will be at the datum level 17, regardless of whether the supply unit 15 contains a smaller or larger amount of molten metal 10.

Figure 4:
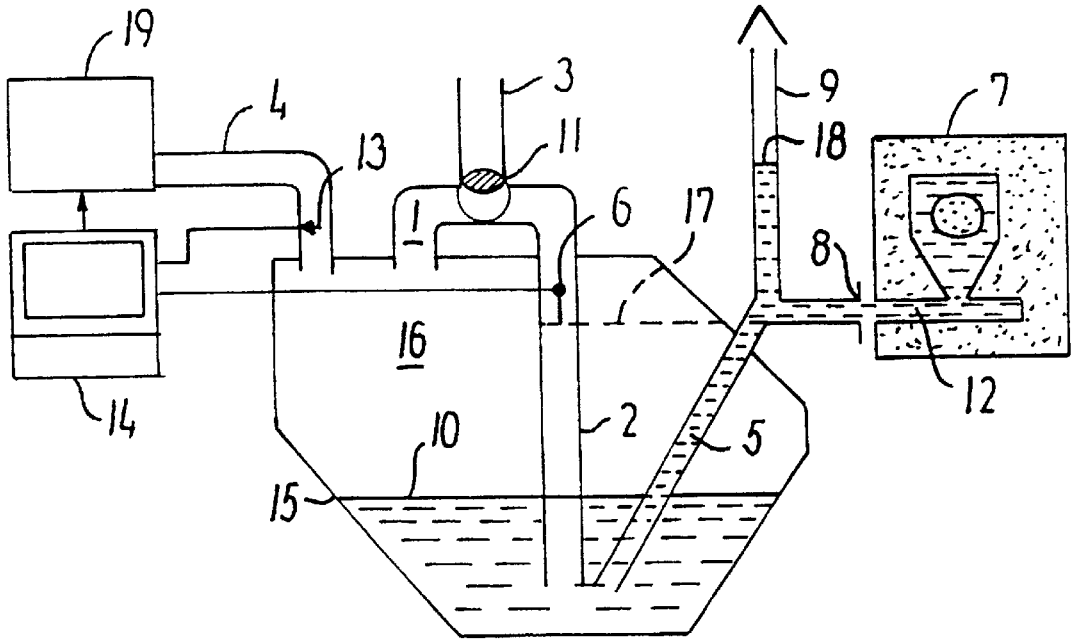

In the step shown in FIG. 4, the pressure in the closed chamber 16 is increased by supplying additional gas through the supply conduit 4, so as to force the molten metal in the filling tube 5 to flow upward, partly to and through the connector 8 into the mould 7 through the latter's runner 12, partly up into the external riser 9 to a filling level 18, that may or may not be monitored by a further level sensor (not shown) e.g. of the same kind as the level sensor 6.

The process of filling the mould 7 in this manner is controlled in a pre-programmed manner by the control unit 14, and it should be noted that the starting point of this process will always be the situation shown in FIG. 3, regardless of the quantity of molten metal in the mass 10. This, again, means that the tilling process proceeds in a manner uninfluenced by the level of metal in the mass 10, and will thus be substantially identical from one mould 7 to the next.

The actual function of time, according to which the filling of the mould 7 takes place by gradually increasing the pressure in the closed chamber 16 in the range above the datum pressure, does not form part of the invention, and will, of course, be adapted to the particular conditions for each run of casting operations, such as the shape and size of the casting cavity, the characteristics of the casting metal etc.

After preventing backflow of the molten metal in the mould 7, such as by means of a suitable closure member (not shown), the pressure in the closed chamber 16 can be reduced down to a value corresponding to the situation shown in FIG. 3 or further, after which the mould 7 can be removed and replaced by a fresh mould. The process of reducing the pressure in the closed chamber 16 can follow a predetermined function of time, e.g. by suitably controlling the pressure applied by the gas-supply unit 19, or by controlling a relief valve (not shown) connecting the closed chamber 16 to atmosphere.

After this, the steps shown in FIGS. 1–4 are repeated, and it should especially be noted as mentioned above that the datum pressure in the closed chamber 16 corresponding to the datum level 17 is measured for each and every mould, thus ensuring equal starting points for all moulds.

What is claimed is:

1. Apparatus for casting articles of metal in moulds having inlets at the side or bottom, the apparatus comprising a) a supply unit for molten metal comprising a closed chamber containing a mass of molten metal in a bottom region thereof and a gas above the mass, b) a filling tube extending from the bottom region upwardly to a connector for temporary connection to a filling duct in a mould for casting an article of metal, c) pressure-varying means to vary the pressure in the gas between (i) low values, at which metal from the mass when rising though the filling tube does not reach the connector, and (ii) higher values, at which molten metal is made to flow through the connector into the filling duct in the mould, d) a sensing tube, the lower end of which extends into the mass, e) a level sensor placed in the sensing tube which reacts when the level of metal in the sensing tube is slightly lower than that of the connector, f) automatic control equipment to which the level sensor and the pressure-varying means are connected for controlling the operation of the apparatus including the pressure-varying means, and g) a switchable connecting system which alternately connects an upper end of the sensing tube to a space outside the closed chamber and to the gas above the mass in the closed chamber.

2. A method of casting articles of metal in moulds having inlets at the side or bottom comprising the steps of:

using a sensing conduit of very small cross-sectional area compared to a surface area of molten metal in a closed chamber with gas above the molten metal, the sensing conduit extending from a bottom region of the closed chamber to an outside of the closed chamber, increasing a pressure of the gas until the level of the molten metal in the sensing conduit reaches a datum level, upon which the pressure of the gas is maintained at this datum value, connecting a mould to a connector connected to a filling tube in the closed chamber, increasing the pressure of the gas into a higher range above the datum value, switching an upper end of the sensing conduit from the outside to the gas in the closed chamber as the pressure is increased from the datum value to prevent backflow in the sensing conduit, when the mould has been filled with molten metal through the connector, reducing the pressure to or below the datum value, and disconnecting the mould from the connector.

3. A method according to claim 2:

a) wherein the sensing conduit is a separate sensing tube which includes a level sensor set at the datum level and connected to automatic control equipment for controlling the casting operation, b) further including the step of measuring the pressure of the gas in the closed chamber with a pressure sensor connected to the automatic control equipment, and c) further including the step of maintaining the pressure of the gas at the datum value measured when the level sensor reacts until the pressure of the gas is increased for filling the mould connected to the connector.

* * * * *

UNITED STATES PATENT AND TRADEMARK OFFICE

CERTIFICATE OF CORRECTION

PATENT NO. : 6,505,677 B1
DATED : January 14, 2003
INVENTOR(S) : Iversen et al.

It is certified that error appears in the above-identified patent and that said Letters Patent is hereby corrected as shown below:

Title page,
Item [75], should read:

-- [75] Inventors: Peter Møller Iversen, Brønshøj (DK);
Uffe Andersen, Skævinge (DK) --

Signed and Sealed this

Twenty-seventh Day of May, 2003

JAMES E. ROGAN
*Director of the United States Patent and Trademark Office*